US007773040B2

(12) United States Patent
Rao et al.

(10) Patent No.: US 7,773,040 B2
(45) Date of Patent: Aug. 10, 2010

(54) DUAL-BAND F-SLOT PATCH ANTENNA

(75) Inventors: Qinjiang Rao, Waterloo (CA); Geyi Wen, Waterloo (CA); Dong Wang, Waterloo (CA); Mark Pecen, Waterloo (CA)

(73) Assignee: Research In Motion Limited, Waterloo, Ontario ( * ) Notice: Subject to any disclaimer, the term of this patent is extended or adjusted under 35 U.S.C. 154(b) by 456 days.

(21) Appl. No.: 11/688,043

(22) Filed: Mar. 19, 2007

(65) Prior Publication Data

US 2008/0231530 A1 Sep. 25, 2008

(51) Int. Cl.
*H01Q 1/24* (2006.01)
*H01Q 1/38* (2006.01)
*H01Q 13/10* (2006.01)

(52) U.S. Cl. ..... 343/729; 343/700 MS; 343/702; 343/767

(58) Field of Classification Search ..... 343/700 MS, 343/767, 702, 729
See application file for complete search history.

(56) References Cited

U.S. PATENT DOCUMENTS 7,023,387 B2 4/2006 Wen et al.
2006/0145927 A1 7/2006 Choi

FOREIGN PATENT DOCUMENTS

EP 0929121 A1 7/1999

*Primary Examiner*—Michael C Wimer
(74) *Attorney, Agent, or Firm*—Heenan Blaikie LLP

(57) ABSTRACT

A dual-band antenna includes a planar conductive layer comprising a conductive region and a central non-conductive region. The conductive region and the non-conductive region together define a pair of interconnected F-slot structures, and a loop strip structure coupled to and disposed around the F-slot patch slot antenna structures.

20 Claims, 8 Drawing Sheets

DUAL-BAND F-SLOT PATCH ANTENNA

FIELD OF THE INVENTION

The invention described herein relates to a multi-band antenna for a handheld wireless communications device. In particular, the invention relates to a dual-band patch antenna.

BACKGROUND OF THE INVENTION

Patch antennas are common in wireless handheld communication devices due to their low profile structure. Further, patch antennas can be implemented with a virtually unlimited number of shapes, thereby allowing such antennas to conform to most surface profiles. Since modern handheld communication devices are required to operate in multiple frequency bands, multi-band patch antennas have been developed for use in such devices.

For instance, Wen (U.S. Pat. No. 7,023,387) describes a dual-band antenna that comprises a first C-shaped patch antenna structure, and a second C-shaped patch antenna structure coupled to the first patch antenna structure, each patch antenna structure having a respective slot structure. The first patch antenna structure includes a signal feed point, and the second patch antenna structure includes a ground point that is proximate the signal feed point.

On the other hand, planar inverted-F antennas (PIFA) are becoming more common in wireless handheld communication devices due to their reduced size in comparison to conventional microstrip antenna designs. Therefore, PIFA antennas have been developed which include multiple resonant sections, each having a respective resonant frequency. However, since conventional PIFA antennas have a very limited bandwidth, broadband technologies, such as parasitic elements and/or multi-layer structures, have been used to modify the conventional PIFA antenna for multi-band and broadband applications.

These approaches increase the size of the antenna, making the resulting designs unattractive for modern handheld communication devices.

Also, the additional resonant branches introduced by these approaches make the operational frequencies of the antennas difficult to tune. Further, the additional branches can introduce significant electromagnetic compatibility (EMC) and electromagnetic interference (EMI) problems.

SUMMARY OF THE INVENTION

According to the invention described herein, a dual-band patch antenna comprises a pair of interconnected F-slot structures, and a loop strip structure that is disposed around the F-slot structures.

In accordance with a first aspect of the invention, there is provided a dual-band patch antenna that comprises a planar conductive layer comprising a conductive region and a central non-conductive region. The conductive region and the non-conductive region together define a pair of interconnected F-slot structures, and a loop strip structure that is coupled to and disposed around the F-slot structures.

In accordance with a second aspect of the invention, there is provided a wireless communication device that comprises a radio transceiver section, and a dual-band antenna coupled to the radio transceiver section. The dual-band antenna comprises a dual-band patch antenna that comprises a planar conductive layer. The conductive layer comprises a conductive region and a central non-conductive region. The conductive region and the non-conductive region together define a pair of interconnected F-slot structures, and a loop strip structure that is coupled to and disposed around the F-slot structures.

In accordance with a third aspect of the invention, there is provided a dual-band patch antenna that comprises a first F-slot patch antenna, and a second F-slot patch antenna that is coupled to the first F-slot patch antenna. The dual-band antenna also comprises a loop strip structure that is coupled to and disposed around the first and second F-slot patch antennas.

As will become apparent, the dual-band antenna is suitable for WLAN 2.45 GHz and 5 GHz applications. Further, the structure of the dual-band antenna has reduced design and fabrication difficulty in comparison to conventional dual-band antennas, and allows the frequencies of the upper and lower bands to be adjusted independently of one another, with improved impedance matching.

BRIEF DESCRIPTION OF THE DRAWINGS

The invention will now be described, by way of example only, with reference to the accompanying drawings, in which.

DETAILED DESCRIPTION OF THE PREFERRED EMBODIMENT

Figure 1:
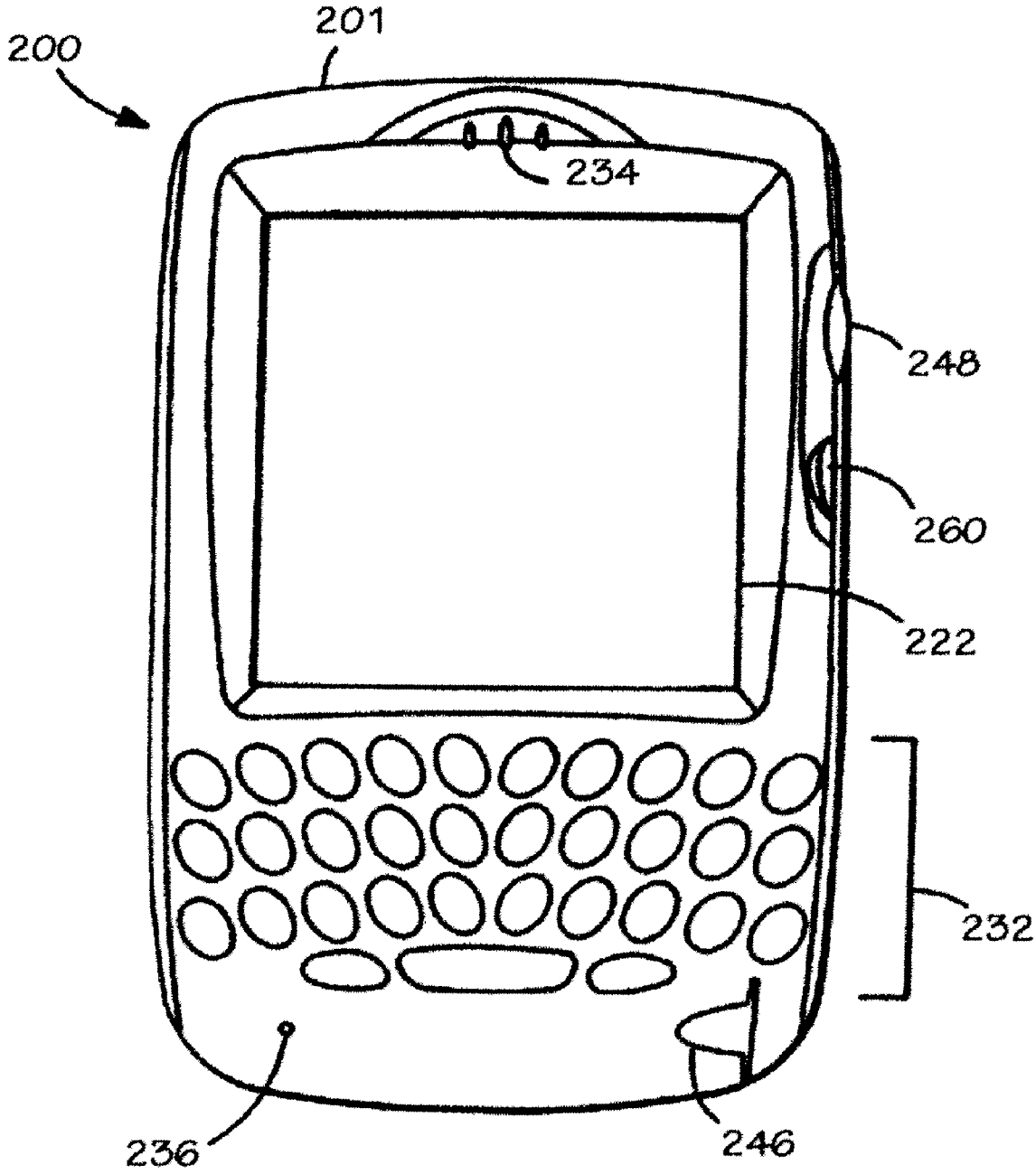
FIG. 1 is a front plan view of a handheld communications device according to the invention.

Turning to FIG. 1, there is shown a sample handheld communications device 200 in accordance with the invention. Preferably, the handheld communications device 200 is a two-way wireless communications device having at least voice and data communication capabilities, and is configured to operate within a wireless cellular network. Depending on the exact functionality provided, the wireless handheld communications device 200 may be referred to as a data messaging device, a two-way pager, a wireless e-mail device, a cellular telephone with data messaging capabilities, a wireless Internet appliance, or a data communication device, as examples.

As shown, the handheld communications device 200 includes a display 222, a function key 246, and data processing means (not shown) disposed within a common housing 201. The display 222 comprises a backlit LCD display. The data processing means is in communication with the display 222 and the function key 246. In one implementation, the backlit display 222 comprises a transmissive LCD display, and the function key 246 operates as a power on/off switch. Alternately, in another implementation, the backlit display 222 comprises a reflective or trans-reflective LCD display, and the function key 246 operates as a backlight switch.

In addition to the display 222 and the function key 246, the handheld communications device 200 includes user data input means for inputting data to the data processing means. As shown, preferably the user data input means includes a keyboard 232, a thumbwheel 248 and an escape key 260. The keyboard 232 includes alphabetic and numerical keys, and preferably also includes a "Send" key and an "End" key to respectively initiate and terminate voice communication. However, the data input means is not limited to these forms of data input. For instance, the data input means may include a trackball or other pointing device instead of (or in addition to) the thumbwheel 248.

Figure 2:
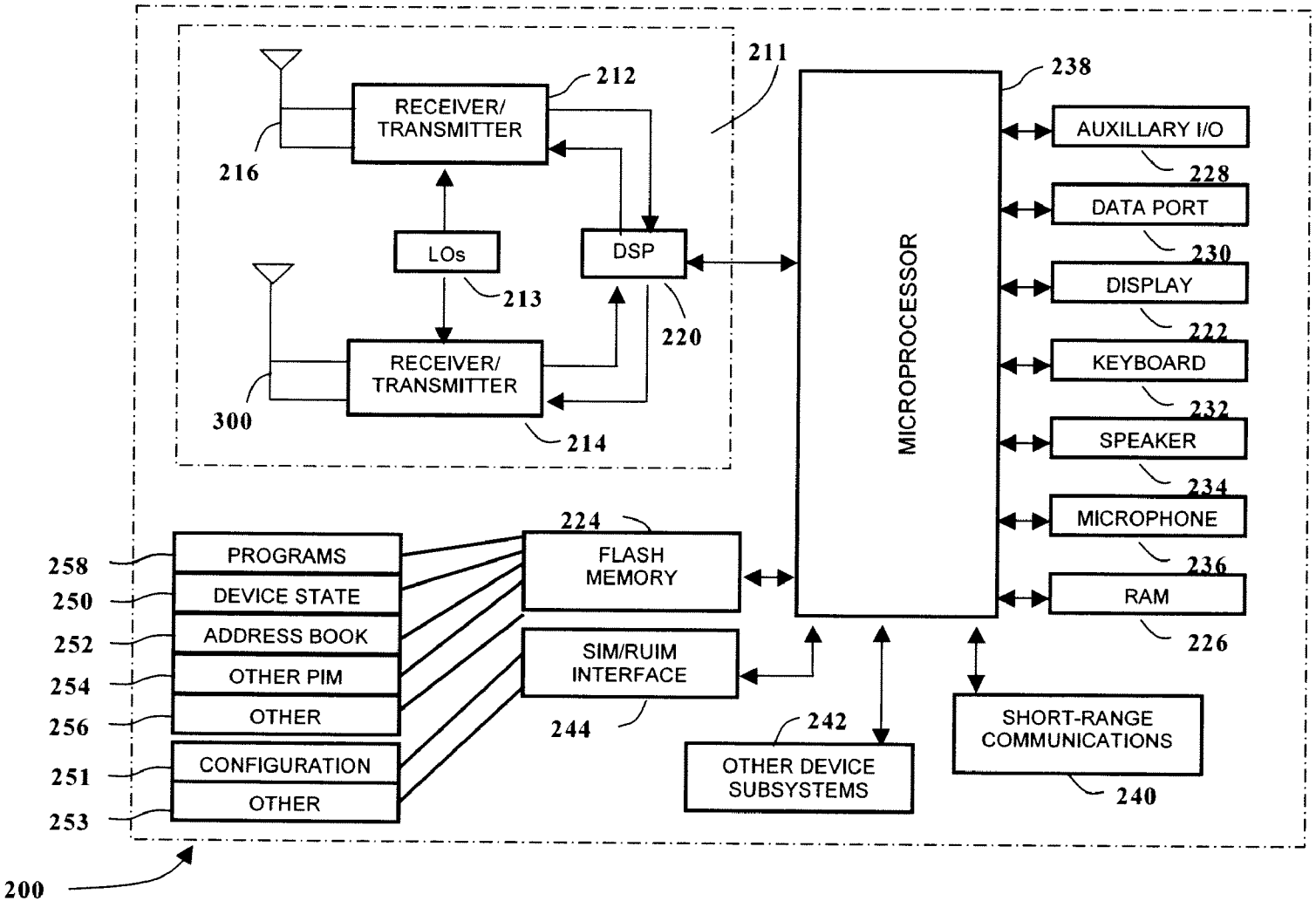
FIG. 2 is a schematic diagram depicting certain functional details of the handheld communications device.

FIG. 2 depicts functional details of the handheld communications device 200. As shown, the handheld communications device 200 incorporates a motherboard that includes a communication subsystem 211, and a microprocessor 238. The communication subsystem 211 performs communication functions, such as data and voice communications, and includes a primary transmitter/receiver 212, a secondary transmitter/receiver 214, a primary internal antenna 216 for the primary transmitter/receiver 212, a secondary internal antenna 300 for the secondary transmitter/receiver 214, and local oscillators (LOs) 213 and one or more digital signal processors (DSP) 220 coupled to the transmitter/receivers 212, 214.

Typically, the communication subsystem 211 sends and receives wireless communication signals over a wireless cellular network via the primary transmitter/receiver 212 and the primary internal antenna 216. Further, typically the communication subsystem 211 sends and receives wireless communication signals over a local area wireless network via the secondary transmitter/receiver 214 and the secondary internal antenna 300.

Preferably, the primary internal antenna 216 is configured for use within a Global System for Mobile Communications (GSM) cellular network or a Code Division Multiple Access (CDMA) cellular network. Further, preferably the secondary internal antenna 300 is configured for use within a WLAN WiFi (IEEE 802.11x) or Bluetooth network. More preferably, the secondary internal antenna 300 is a dual-band patch antenna that is configured for use within 802.11b/g, 802.11a/j and Bluetooth WLAN networks. Although the handheld communications device 200 is depicted in FIG. 2 with two antennas, it should be understood that the handheld communications device 200 may instead comprise only a single antenna, with the dual-band antenna 300 being connected to both the primary transmitter/receiver 212 and the secondary transmitter/receiver 214. Further, although FIG. 2 depicts the dual-band antenna 300 incorporated into the handheld communications device 200, the dual-band antenna 300 is not limited to mobile applications, but may instead by used with a stationary communications device. The preferred structure of the dual-band antenna 300 will be discussed in detail below, with reference to FIGS. 3 to 8.

Signals received by the primary internal antenna 216 from the wireless cellular network are input to the receiver section of the primary transmitter/receiver 212, which performs common receiver functions such as frequency down conversion, and analog to digital (A/D) conversion, in preparation for more complex communication functions performed by the DSP 220. Signals to be transmitted over the wireless cellular network are processed by the DSP 220 and input to transmitter section of the primary transmitter/receiver 212 for digital to analog conversion, frequency up conversion, and transmission over the wireless cellular network via the primary internal antenna 216.

Similarly, signals received by the secondary internal antenna 300 from the local area wireless network are input to the receiver section of the secondary transmitter/receiver 214, which performs common receiver functions such as frequency down conversion, and analog to digital (A/D) conversion, in preparation for more complex communication functions performed by the DSP 220. Signals to be transmitted over the local area wireless network are processed by the DSP 220 and input to transmitter section of the secondary transmitter/receiver 214 for digital to analog conversion, frequency up conversion, and transmission over the local area wireless network via the secondary internal antenna 300. If the communication subsystem 211 includes more than one DSP 220, the signals transmitted and received by the secondary transmitter/receiver 214 would preferably be processed by a different DSP than the primary transmitter/receiver 212.

The communications device 200 also includes a SIM interface 244 if the handheld communications device 200 is configured for use within a GSM network, and/or a RUIM interface 244 if the handheld communications device 200 is configured for use within a CDMA network. The SIM/RUIM interface 244 is similar to a card-slot into which a SIM/RUIM card can be inserted and ejected like a diskette or PCMCIA card. The SIM/RUIM card holds many key configurations 251, and other information 253 including subscriber identification information, such as the International Mobile Subscriber Identity (IMSI) that is associated with the handheld communications device 200, and subscriber-related information.

The microprocessor 238, in conjunction with the flash memory 224 and the RAM 226, comprises the aforementioned data processing means and controls the overall operation of the device. The data processing means interacts with device subsystems such as the display 222, flash memory 224, RAM 226, auxiliary input/output (I/O) subsystems 228, data port 230, keyboard 232, speaker 234, microphone 236, short-range communications subsystem 240, and device subsystems 242. The data port 230 may comprise a RS-232 port, a Universal Serial Bus (USB) port or other wired data communication port.

As shown, the flash memory 224 includes both computer program storage 258 and program data storage 250, 252, 254 and 256. Computer processing instructions are preferably also stored in the flash memory 224 or other similar non-volatile storage. Other computer processing instructions may also be loaded into a volatile memory such as RAM 226. The computer processing instructions, when accessed from the memory 224, 226 and executed by the microprocessor 238 define an operating system, computer programs, operating system specific applications. The computer processing instructions may be installed onto the handheld communications device 200 upon manufacture, or may be loaded through the cellular wireless network, the auxiliary I/O subsystem 228, the data port 230, the short-range communications subsystem 240, or the device subsystem 242.

The operating system allows the handheld communications device 200 to operate the display 222, the auxiliary input/output (I/O) subsystems 228, data port 230, keyboard 232, speaker 234, microphone 236, short-range communications subsystem 240, and device subsystems 242. Typically, the computer programs include communication software that configures the handheld communications device 200 to receive one or more communication services. For instance, preferably the communication software includes internet browser software, e-mail software and telephone software that respectively allow the handheld communications device 200 to communicate with various computer servers over the internet, send and receive e-mail, and initiate and receive telephone calls.

Figure 3:
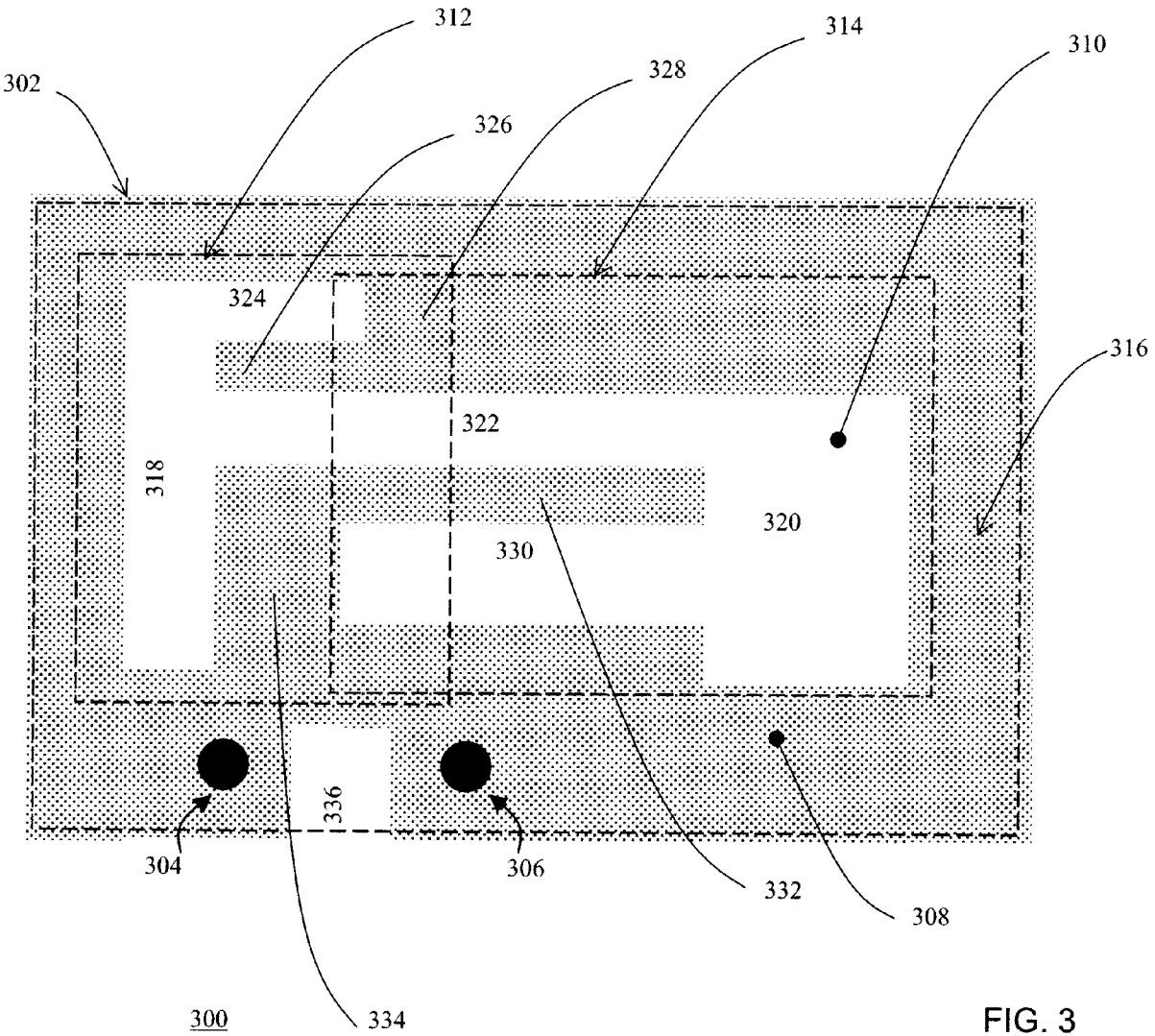
FIG. 3 is a top plan view of a dual-band F-slot patch antenna of the handheld communications device, suitable for use with a wireless cellular network.

FIG. 3 depicts the preferred structure for the dual-band antenna 300. The dual-band antenna 300 comprises a planar conductive layer 302. Preferably, the planar conductive layer 302 is disposed on a substrate layer (not shown). As shown, the conductive layer 302 has a substantially rectangular shape having two opposed pairs of substantially parallel edges. Preferably, the dual-band antenna 300 is implemented as a printed circuit board, with the planar conductive layer 302 comprising copper or other suitable conductive metal.

The conductive layer 302 comprises a conductive region 308 and a central non-conductive region 310. In contrast to the conductive region 308, the non-conductive region 310 is devoid of conductive metal. Typically, the non-conductive region 310 is implemented via suitable printed circuit board etching techniques.

As will become apparent, the non-conductive region 310 and the surrounding conductive region 308 define first and second interconnected high frequency planar F-slot structures 312, 314, and a lower frequency planar loop strip structure 316 that is coupled to and disposed around the F-slot structures 312, 314. Together, the F-slot structures 312, 314 and the loop strip structure 316 comprise a dual-band F-slot patch antenna. The phrase "F-slot structure" is used herein to indicate that the structures 312, 314 each have slots that are arranged into a planar "F" structure.

The non-conductive region 310 comprises a first non-conductive section 318, a second non-conductive section 320, and a non-conductive connecting branch 322 that interconnects the first and second non-conductive sections 318, 320. The first non-conductive section 318 and the second non-conductive section 320 are substantially parallel to each other.

Preferably, the first and second non-conductive sections 318, 320 are parallel to one pair of opposing edges of the conductive layer 302. Further, preferably the connecting branch 322 is parallel to the other pair of opposing edges of the conductive layer 302.

As shown, the first F-slot structure 312 comprises the first non-conductive section 318 and a portion of the connecting branch 322. Similarly, the second F-slot structure 314 comprises the second non-conductive section 320 and the remaining portion of the connecting branch 322.

The first F-slot structure 312 also comprises a first non-conductive branch 324 that is implemented within the non-conductive region 310. The first non-conductive branch 324 is continuous with the first non-conductive section 318 at one end of the first non-conductive branch 324, and extends substantially perpendicularly from the first non-conductive section 318 towards the opposite end of the first non-conductive branch 324.

In addition, the first F-slot structure 312 comprises a first conductive branch 326 that is implemented within the conductive region 308. The first conductive branch 326 is disposed between the first non-conductive branch 324 and the non-conductive connecting branch 322. Preferably, the first conductive branch 326 is substantially parallel to the non-conductive connecting branch 322.

Further, the first F-slot structure 312 also comprises a first conductive section 328 that is implemented within the conductive region 308. The first conductive section 328 is disposed between the second non-conductive section 320 and the opposite end of the first non-conductive branch 324.

Similarly, the second F-slot structure 314 also comprises a second non-conductive branch 330 that is implemented within the non-conductive region 310. The second non-conductive branch 330 is continuous with the second non-conductive section 320 at one end of the second non-conductive branch 330, and extends substantially perpendicularly from the second non-conductive section 320 towards the opposite end of the second non-conductive branch 330.

In addition, the second F-slot structure 314 comprises a second conductive branch 332 that is implemented within the conductive region 308. The second conductive branch 332 is disposed between the second non-conductive branch 330 and the non-conductive connecting branch 322. Preferably, the second conductive branch 332 is substantially parallel to the non-conductive connecting branch 322.

Further, the second F-slot structure 314 also comprises a second conductive section 334 that is implemented within the conductive region 308. The second conductive section 334 is disposed between the first non-conductive section 318 and the opposite end of the second non-conductive branch 330.

The low frequency loop strip structure 316 comprises a radiating element, a signal feed portion, and a shorting portion that are implemented within the conductive region 308. The radiating element is coupled to and disposed around the first and second F-slot structures, 312, 314, and extends continuously around the circumference of the conductive layer 302 from the signal feed portion to the shorting portion. The loop strip structure 316 also comprises a non-conductive slot 336 that is disposed between the signal feed portion and the shorting portion, and extends inwardly from one edge of the conductive layer 302. As shown, a feed pin 304 is connected to the signal feed portion, and a ground pin 306 is connected to the shorting portion.

FIG. 4 to 8 are computer simulations of the return loss for the dual-band F-slot patch antenna 300. In these simulations:

W is the width of the conductive layer 302

L is the length of the conductive layer 302

$L_f$ is the length of the first non-conductive branch 324

$L_u$ is the length of the non-conductive connecting branch 322

$L_g$ is the length of the non-conductive slot 336, as measured from the edge of the conductive layer 302

Figure 4:
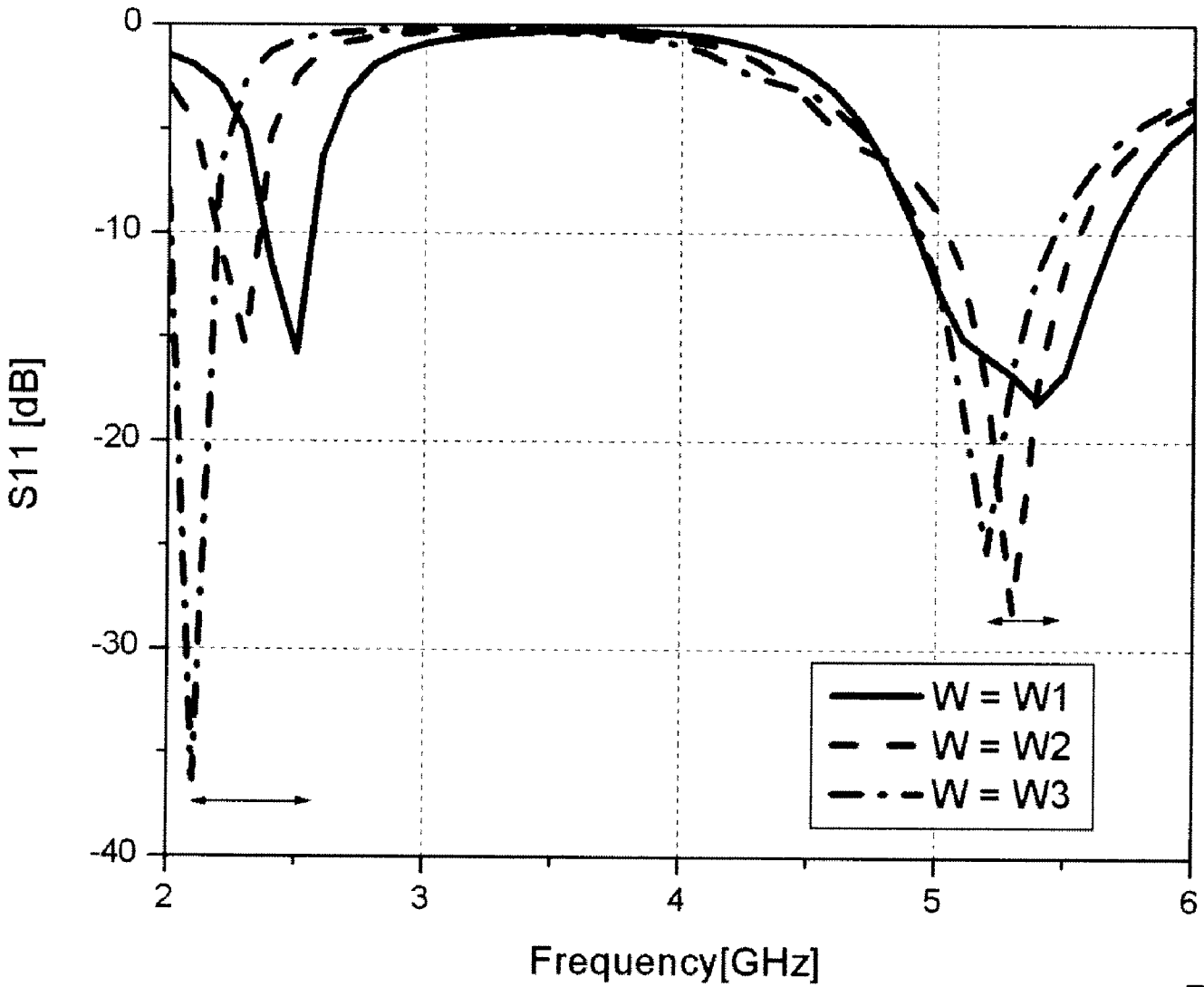
FIG. 4 to 7 are computer simulations of the return loss for the dual-band F-slot patch antenna.

FIG. 4 depicts the variation in return loss of the dual-band antenna 300 with width W. In this simulation, L=14 mm; $L_f$=2 mm; $L_u$=10.5 mm; $L_g$=9 mm. This simulation reveals that the width of the loop strip structure 316 has a preferential impact on the centre frequency and impedance of the lower frequency band, in comparison to the higher frequency band. This result is advantageous since it reveals that the frequency and impedance of the lower frequency band can be adjusted by varying the length of the loop strip structure 316, without significantly impacting the characteristics of the upper frequency band.

Figure 5:
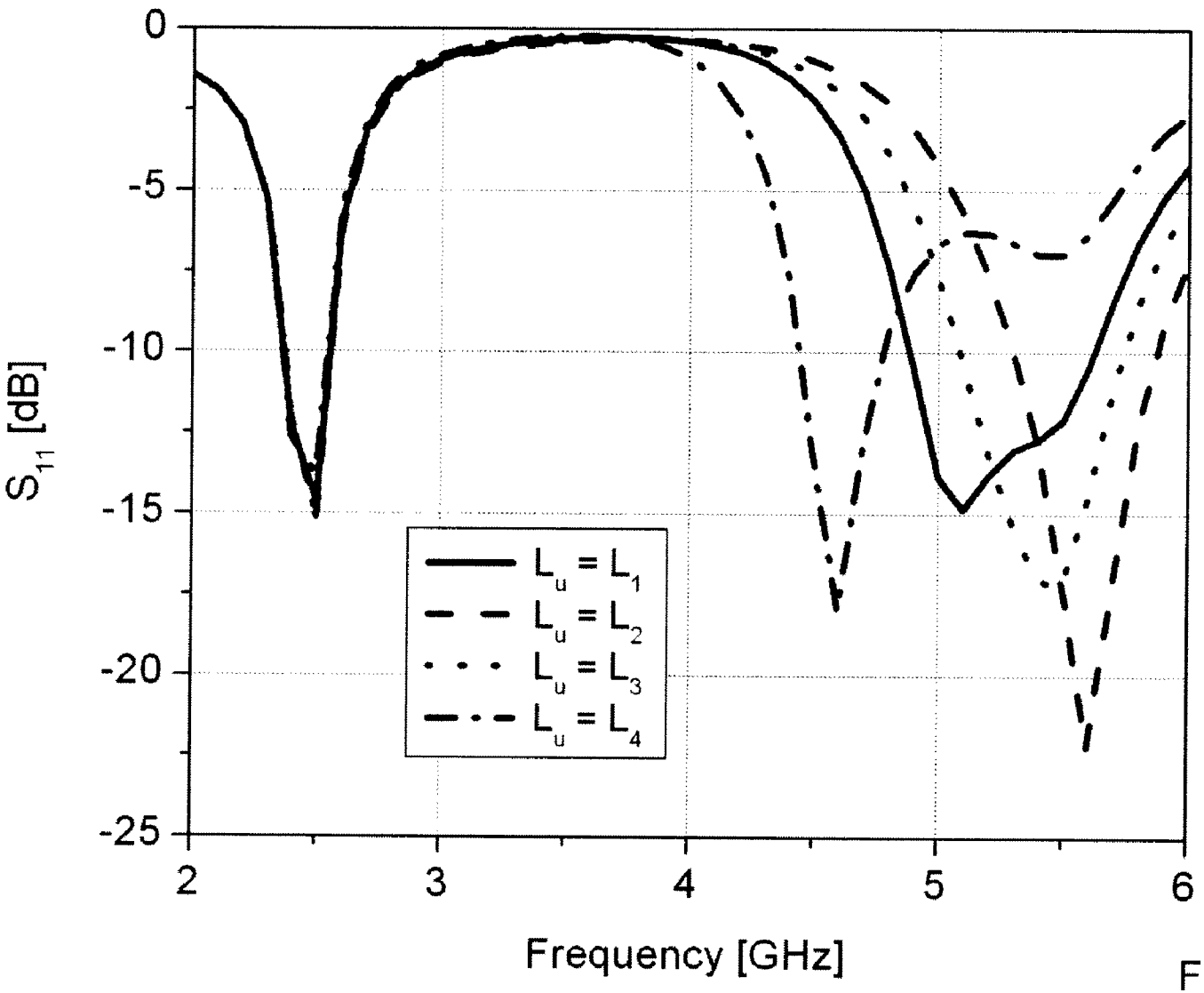

FIG. 5 depicts the variation in return loss with $L_u$. In this simulation, W=21 mm; L=14 mm; $L_f$=2 mm; $L_g$=9 mm. This simulation reveals that the centre frequency and impedance of the upper frequency band are sensitive to variations in the length of the non-conductive connecting branch 322 and the second non-conductive branch 330. This result is advantageous since it reveals that the frequency and impedance of the upper frequency band can be adjusted by varying the width of the second F-slot structure 314, without impacting the characteristics of the lower frequency band.

Figure 6:
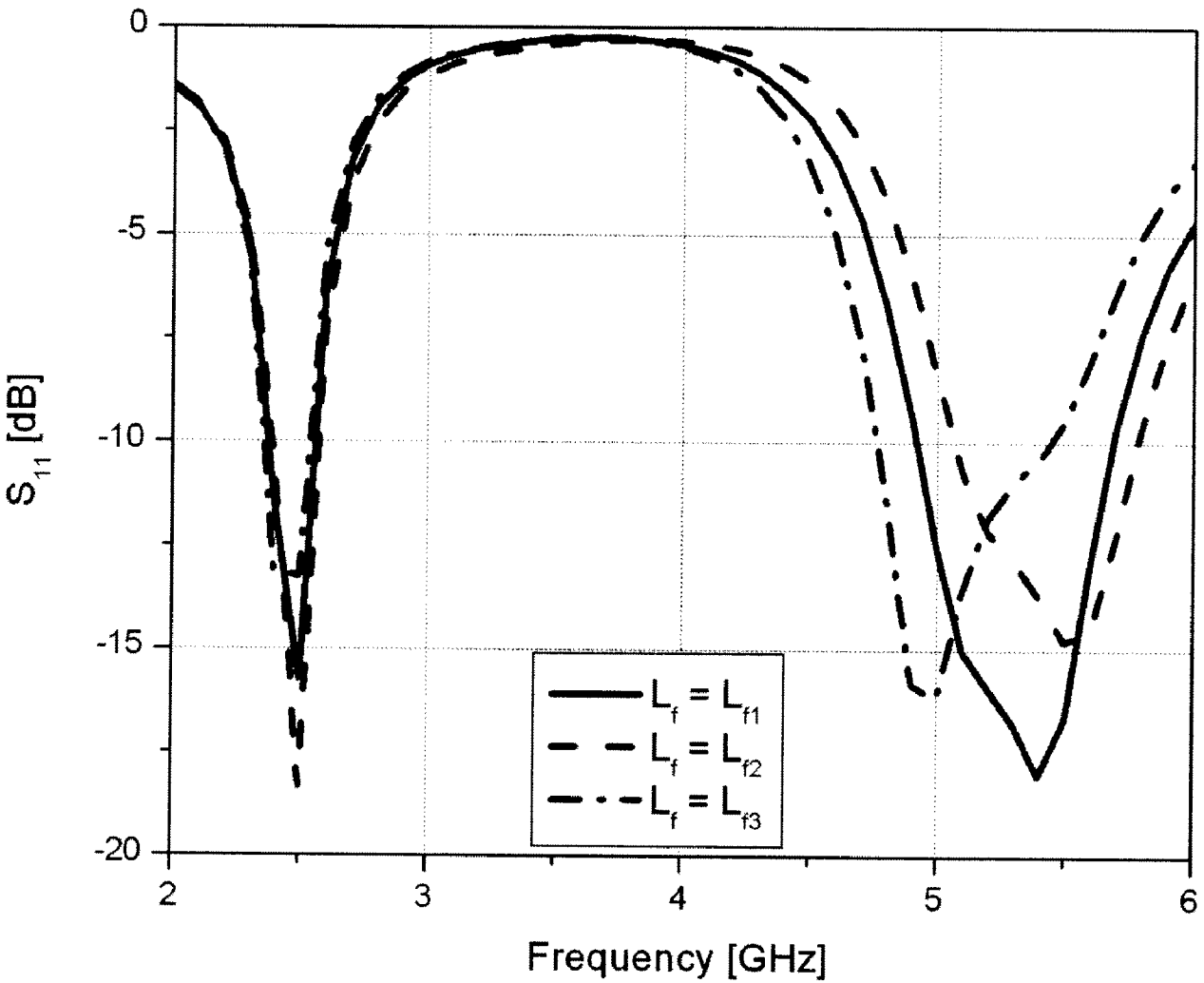

FIG. 6 depicts the variation in return loss with $L_f$. In this simulation, W=21 mm; L=14 mm; $L_u$=10.5 mm; $L_g$=9 mm. This simulation reveals that the centre frequency and impedance of the upper frequency band are sensitive to variations in the length of the first non-conductive branch 324. Further, the centre frequency of the lower frequency band is insensitive, and the impedance of the lower frequency band is moderately sensitive, to variations in the length of the first non-conductive branch 324. This result is advantageous since it reveals that the centre frequency of the upper frequency band can be adjusted independently of the centre frequency of the lower frequency band, by varying the width of the first F-slot structure 312. Further, the impedance of the lower frequency band can be adjusted independently of its centre frequency.

Figure 7:
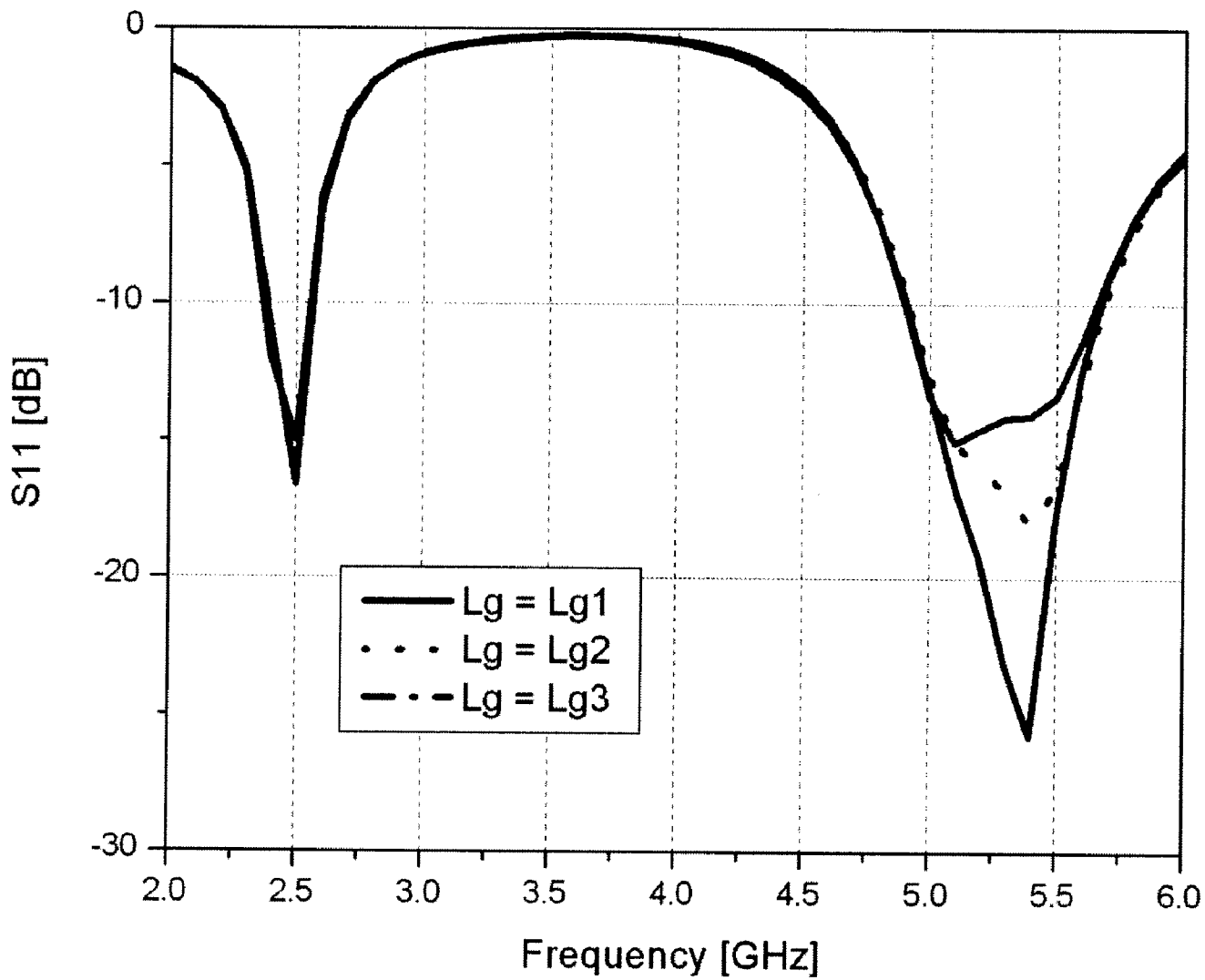

FIG. 7 depicts the variation in return loss with $L_g$. In this simulation, W=21 mm; L=14 mm; $L_f$=2 mm; $L_u$=10.5 mm. This simulation reveals that the impedance of the upper frequency band is sensitive to variations in the length of the non-conductive slot 336. Further, the centre frequency and impedance of the lower frequency band is insensitive to variations in the length of the non-conductive slot 336. This result is advantageous since it reveals that the impedance of the upper frequency band can be adjusted by varying the slot length of the loop strip structure 316, without impacting the characteristics of the lower frequency band.

Figure 8:
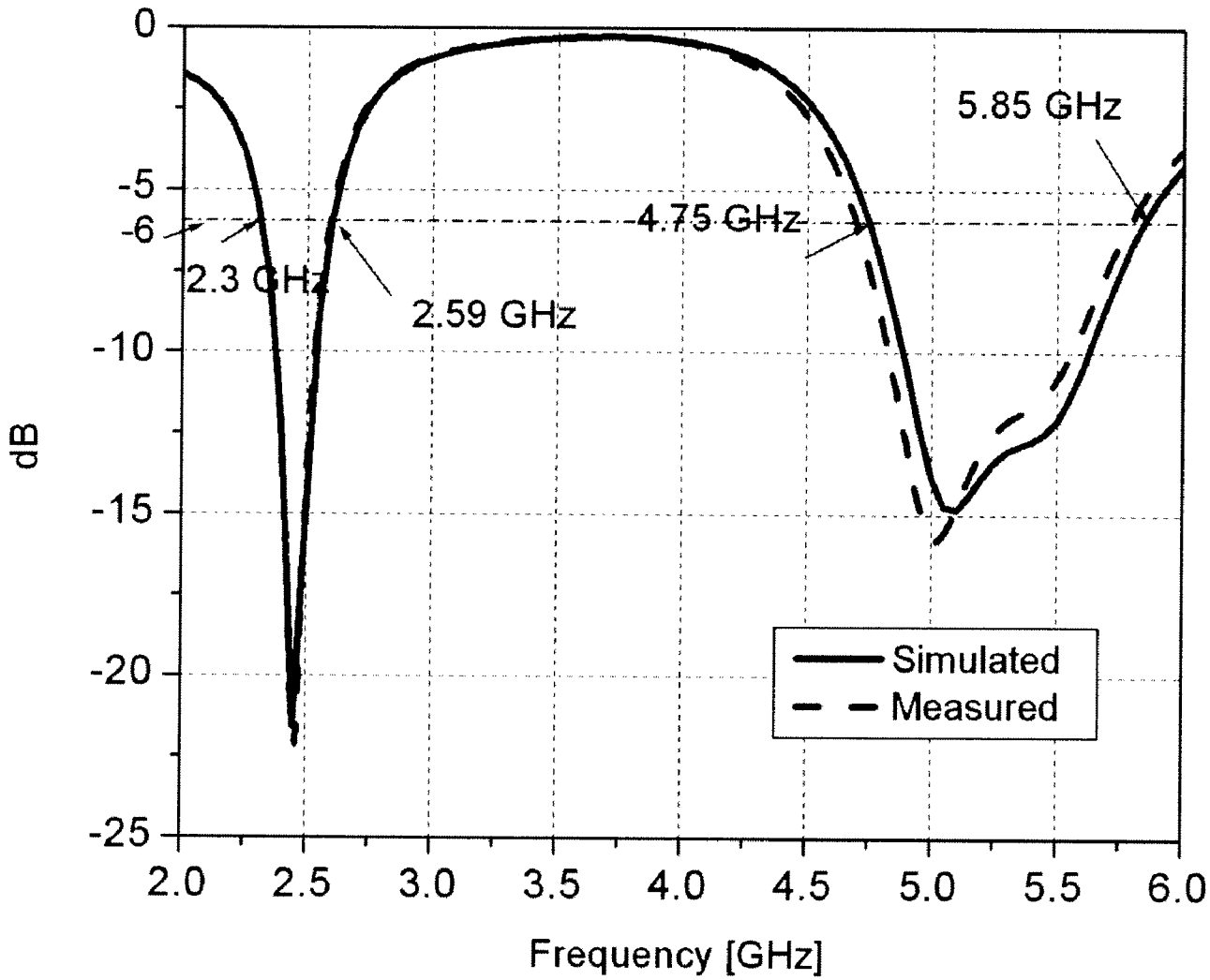
FIG. 8 depicts the computer simulated and actual return loss for a preferred implementation of the dual-band F-slot patch antenna.

FIG. 8 depicts the computer simulated and actual performance of a dual-band F-slot patch antenna 300 having the following dimensions: W=21 mm; L=14 mm; $L_f$=2 mm; $L_u$=10.5 mm; $L_g$=9 mm. This graph reveals that the dual-band antenna 300 has a low frequency range that extends from 2.3 GHz to 2.59 GHz, and a centre frequency of 2.45 GHz. The graph also reveals that the dual-band antenna 300 has a wide higher frequency range that extends from 4.75 GHz to 5.85 GHz, and a centre frequency around 5 GHz.

As will be appreciated from the foregoing discussion, the low frequency band of the dual-band antenna 300 is suitable for WLAN 802.11b/g or Bluetooth applications, and the higher frequency band of the dual-band antenna 300 is suitable for WLAN 802.11a/j applications. However, in contrast to conventional dual-band antenna designs, the frequency of the upper and lower bands of the dual-band antenna 300 can be adjusted independently of one another, with improved impedance matching. These results are obtained in a structure having reduced design and fabrication difficulty.

The scope of the monopoly desired for the invention is defined by the claims appended hereto, with the foregoing description being merely illustrative of the preferred embodiment of the invention. Persons of ordinary skill may envisage modifications to the described embodiment which, although not explicitly suggested herein, do not depart from the scope of the invention, as defined by the appended claims.

We claim:

1. A dual-band patch antenna comprising:

a planar conductive layer comprising a conductive region and a central non-conductive region, the conductive region and the non-conductive region together defining a pair of interconnected F-slot structures and a loop strip structure coupled to and disposed around the F-slot structures, the loop strip structure comprising a signal feed portion, a shorting portion, and a non-conductive slot disposed between the signal feed portion and the shorting portion.

2. The dual-band antenna according to claim 1, wherein the non-conductive region comprises first and second substantially parallel non-conductive sections, and a non-conductive connecting branch interconnecting the first and second non-conductive sections, a first of the F-slot structures comprising the first non-conductive section and a portion of the connecting branch, a second of the F-slot structures comprising the second non-conductive section and a remaining portion of the connecting branch.

3. The dual-band antenna according to claim 2, wherein the first F-slot structure comprises a first non-conductive branch, continuous with the first non-conductive section, and extending substantially perpendicularly from the first non-conductive section, and the second F-slot structure comprises a second non-conductive branch, continuous with the second non-conductive section, and extending substantially perpendicularly from the second non-conductive section.

4. The dual-band antenna according to claim 3, wherein the conductive region comprises a first conductive branch disposed between the first non-conductive branch and the portion of the connecting branch, and a second conductive branch disposed between the first non-conductive branch and the remaining portion of the connecting branch.

5. The dual-band antenna according to claim 4, wherein the conductive region comprises a first conductive section disposed between an end of the first non-conductive branch and the second non-conductive section, and a second conductive section disposed between an end of the second non-conductive branch and the first non-conductive section.

6. The dual-band antenna according to claim 4, wherein the conductive layer has a rectangular shape comprising opposing pairs of substantially parallel edges, the non-conductive sections extend substantially parallel to one pair of the parallel edges, and the non-conductive branches and the connection branch extend substantially parallel to another pair of the parallel edges.

7. The dual-band antenna according to claim 3, wherein the non-conductive connecting branch is disposed between the first and second non-conductive branches and extends substantially parallel to the first and second non-conductive branches.

8. A wireless communications device comprising:

a radio transceiver section; and a dual-band antenna coupled to the radio transceiver section, the dual-band antenna comprising:

a planar conductive layer comprising a conductive region and a central non-conductive region, the conductive region and the non-conductive region together defining a pair of interconnected F-slot structures and a loop strip structure coupled to and disposed around the F-slot structures, the loop strip structure comprising a signal feed portion, a shorting portion, and a non-conductive slot disposed between the signal feed portion and the shorting portion.

9. The wireless communications device according to claim 8, wherein the non-conductive region comprises first and second substantially parallel non-conductive sections, and a non-conductive connecting branch interconnecting the first and second non-conductive sections, a first of the F-slot structures comprising the first non-conductive section and a portion of the connecting branch, a second of the F-slot structures comprising the second non-conductive section and a remaining portion of the connecting branch.

10. The wireless communications device according to claim 9, wherein the first F-slot structure comprises a first non-conductive branch, continuous with the first non-conductive section, and extending substantially perpendicularly from the first non-conductive section, and the second F-slot structure comprises a second non-conductive branch, continuous with the second non-conductive section, and extending substantially perpendicularly from the second non-conductive section.

11. The wireless communications device according to claim 10, wherein the conductive region comprises a first conductive branch disposed between the first non-conductive branch and the portion of the connecting branch, and a second conductive branch disposed between the first non-conductive branch and the remaining portion of the connecting branch.

12. The wireless communications device according to claim 11, wherein the conductive region comprises a first conductive section disposed between an end of the first non-conductive branch and the second non-conductive section, and a second conductive section disposed between an end of the second non-conductive branch and the first non-conductive section.

13. The wireless communications device according to claim 12, wherein the loop strip structure comprises a radiating element extending continuously around a circumference of the planar conductive layer from the signal feed portion to the shorting portion the signal feed portion being coupled to the radio transceiver section.

14. The wireless communications device according to claim 10, wherein the non-conductive connecting branch is disposed between the first and second non-conductive branches and extends substantially parallel to the first and second non-conductive branches.

15. A dual-band antenna comprising:

a first F-slot structure;

a second F-slot structure coupled to the first F-slot structure ; and a loop strip structure coupled to and disposed around the first and second F-slot structures, the loop strip structure comprising a signal feed portion, a shorting portion, and a non-conductive slot disposed between the signal feed portion and the shorting portion.

16. The dual-band antenna according to claim 15, wherein the first F-slot structure comprises a first non-conductive section and a first interconnecting non-conductive branch, the second F-slot structure comprises a second non-conductive section and a second interconnecting non-conductive branch continuous with the first non-conductive branch and interconnecting the first and second non-conductive sections, and the second non-conductive section is substantially parallel to the first non-conductive section.

17. The dual-band antenna according to claim 16, wherein the first F-slot structure comprises a first non-conductive branch, continuous with the first non-conductive section, and extending substantially perpendicularly from the first non-conductive section, and the second F-slot structure comprises a second non-conductive branch, continuous with the second non-conductive section, and extending substantially perpendicularly from the second non-conductive section.

18. The dual-band antenna according to claim 17, further comprising a first conductive branch disposed between the first non-conductive branch and the first interconnecting non-conductive branch, and a second conductive branch disposed between the first non-conductive branch and the second interconnecting non-conductive branch.

19. The dual-band antenna according to claim 18, further comprising a first conductive section disposed between an end of the first non-conductive branch and the second non-conductive section, and a second conductive section disposed between an end of the second non-conductive branch and the first non-conductive section.

20. The dual-band antenna according to claim 17, wherein the interconnecting non-conductive branches are disposed between the first and second non-conductive branches and extends substantially parallel to the first and second non-conductive branches.

* * * * *